United States Patent [19]

Pulda

[11] 4,008,890

[45] * Feb. 22, 1977

[54] METHOD AND APPARATUS FOR TRANSPORTING MATERIALS

[75] Inventor: William F. Pulda, Piscataway, N.J.

[73] Assignee: Vanguard Machinery Corporation, Edison, N.J.

[ * ] Notice: The portion of the term of this patent subsequent to Sept. 28, 1993, has been disclaimed.

[22] Filed: June 5, 1975

[21] Appl. No.: 574,954

Related U.S. Application Data

[63] Continuation-in-part of Ser. No. 545,038, Jan. 29, 1975, Pat. No. 3,982,750.

[52] U.S. Cl. ..... 271/151; 214/6 C; 214/8.5 A; 271/3.1; 271/263

[51] Int. Cl.[2] ..... B65H 5/24

[58] Field of Search ..... 271/3.1, 151, 262, 263, 271/275, 35, 165, 270; 198/34, 35; 214/6 C, 8.5 A

[56] References Cited

UNITED STATES PATENTS

| | | | |
|---|---|---|---|
| 2,318,132 | 5/1943 | Welk | 271/263 X |
| 3,262,697 | 7/1966 | Krinke | 271/35 X |
| 3,422,969 | 1/1969 | Miller et al. | 271/3.1 X |
| 3,643,939 | 2/1972 | Nussbaum et al. | 271/3.1 X |
| 3,860,234 | 1/1975 | Parenti et al. | 271/263 |
| 3,885,781 | 5/1975 | Krebs | 271/3.1 |

*Primary Examiner*—Evon C. Blunk
*Assistant Examiner*—Bruce H. Stoner, Jr.
*Attorney, Agent, or Firm*—George E. Kersey

[57] ABSTRACT

Method and apparatus employing serially positioned conveyors which are reorientable relative to one another in order to position an incoming stack of materials for transport and automatic stacking at an output position. Two of the conveyors are tiltable to upset the stack and provide initial shingling. Further shingling is achieved using an inclinable shingling conveyor in conjunction with a stripper unit.

11 Claims, 11 Drawing Figures

SPEED OF BACKREST CONVEYOR

METHOD AND APPARATUS FOR TRANSPORTING MATERIALS

BACKGROUND OF THE INVENTION

This application is a continuation-in-part of Ser. No. 545,038, filed Jan. 29, 1975 now U.S. Pat. No. 3,982,750. The invention relates to the transport of materials and, more particularly, to the automatic transport of sheet material.

It is often necessary to transport sheet material. For example, corrugated or cardboard sheets, which are often received in stack form and are loaded into a hopper of the unit that feeds the sheets to a press to be imprinted with a desired legend.

Although the stacks can be transported manually from a receiving dock and then manually loaded into the hopper, it is desirable to completely automate the handling of the stacks. For that purpose, a number of systems have been proposed, such as those disclosed in U.S. Pat. No. 3,422,969 which issued to J. A. Miller, et al. on Jan. 21, 1969, and U.S. Pat. No. 3,643,939 which issued to H. A. Nussbaum, et al. on Feb. 22, 1972. These systems involve the transport of a stack to a position where the stack is upset to permit shingling feed of the sheets to an output location.

The foregoing and other prior art systems have a number of disadvantages. In each case, for example, if there is a mechanical or other failure which requires temporary shutdown of the system for repair, the interposition of the system between the receiving or input station and the output location, interferes with the continued use of the output equipment.

Other difficulties encounted in the prior systems are set forth in Ser. No. 545,038.

One of the most important requirements in an automatic feed system is the shingling of sheets from the upset stack. Unless the sheets have a free margin, they cannot be fed properly and can cause machine jamming.

Proper shingling is difficult to achieve in systems which are intended to handle relatively large and heavy sheets of material. Because of appreciable surface contact area and the weight of the sheets, surface cohesion tends to interfere with proper shingling.

Accordingly, it is an object of the invention to facilitate the automatic transport of sheets of material from an input position to an output position. A related object is to facilitate the upset of a stack of materials and the shingled feed of the upset stack to the output position. A related object is to facilitate the shingled feed of large and heavy sheets of material.

Another object of the invention is to provide a transport system which will not prevent the through-flow of materials when the system is temporarily shutdown, for example, for repair.

A further object is to facilitate the shingling of large and heavy individual sheets of material, both during upset and during subsequent transport of the sheets to the output position.

SUMMARY OF THE INVENTION

In accomplishing the foregoing and related objects, the invention provides for conveying a stack of materials to a prescribed position, and changing the orientation of the conveyors and the stack at the prescribed position.

In accordance with one aspect of the invention, the conveyors are operable to enhance the desired shingling. This is accomplished by causing the stack to fall against one of the conveyors and reduce the surface cohesive effects.

In accordance with a further aspect of the invention the conveyor that receives the upset stack has smooth surfaced conveyor belts to facilitate the shingling separation of the sheets, while the remaining conveyors have rough surfaced belts to facilitate sheet transport.

In accordance with still another aspect of the invention, a removable stripper unit is used in conjunction with an inclinable shingling conveyor in order to assure the desired separation of the sheets. The stripper unit is removable to permit manual throughput feed of the sheets when that is desired.

DESCRIPTION OF THE DRAWINGS

Other aspects of the invention will become apparent after considering several illustrative embodiments taken in conjunction with the drawings in which

FIGS. 2A, 2B and 2C are a set of views illustrating the operation of the conveyors of FIG. 1, in which FIG. 2A shows the backrest conveyor elevated, FIG. 2B shows a stack being upset, and FIG. 2C shows feed of the upset stack;

FIGS. 7A and 7B are a set of graphs illustrating the operation of the system of FIGS. 2 and 3, in which FIG. 7A illustrates the elevation of the backrest conveyor, and FIG. 7B illustrates the various speeds, over time, of the backrest conveyor.

DETAILED DESCRIPTION

Figure 1:
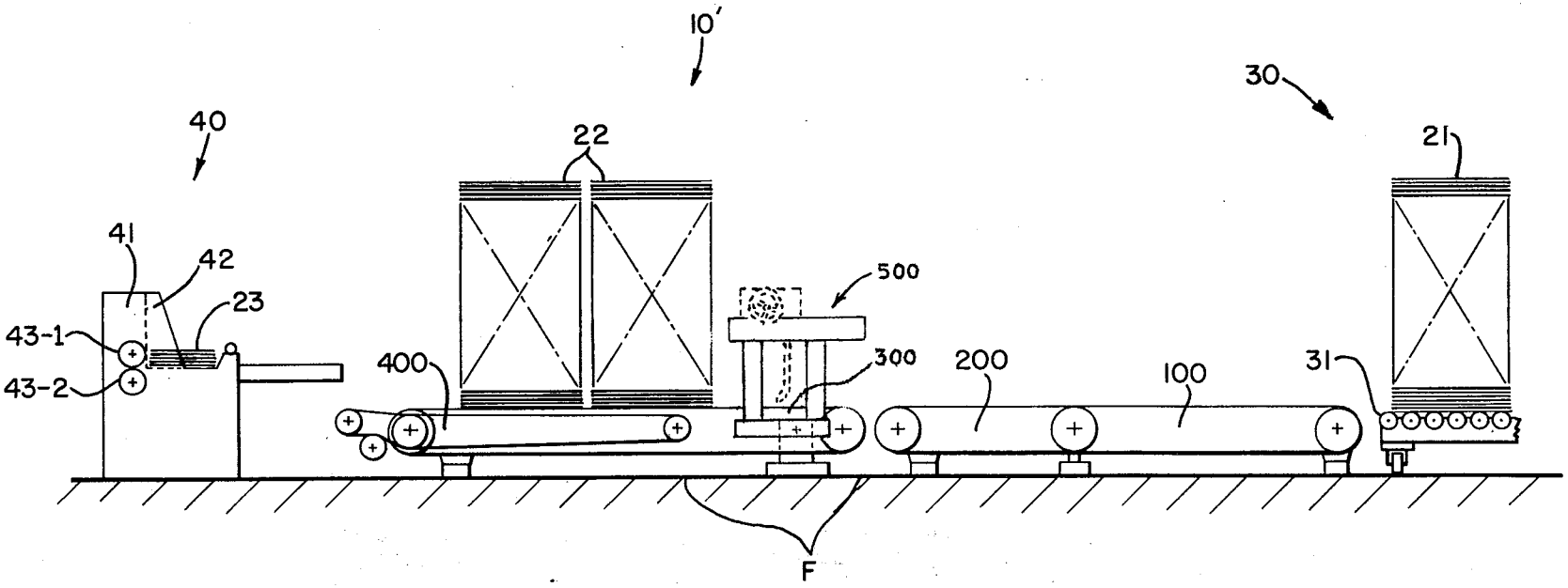
FIG. 1 is a side view of an alternative system in accordance with the invention, employing a removable stripper unit and having its constituent conveyors in a horizontal position to permit direct feed of materials from an input location to an output location.

Turning to the drawings, an alternative transport system 10' in accordance with the invention is shown in one of its possible configurations in FIG. 1. This configuration applies when it is desired to use the system 10' for the thru-feed of materials, such as the feed of illustrative stacks 21 and 22 shown in FIG. 12 of corrugated sheets, from a receiving or input position 30 to a sending or output position 40.

The system 10' is formed by tiltable conveyors 100 and 200; a shingling conveyor 300; and an output conveyor 400. The shingling conveyor 300 is used in conjunction with a stripper 500, which is shown in dashed-line outline in FIG. 1, since it is removed when the conveyors 100 through 400 are in their horizontal positions for the throughfeed of materials.

The input position 30 includes a manual, roller conveyor 31 on which the stacks are initially placed and are thereafter moved onto the conveyor system 10 to be transported to the output position 40 for either manual or, as described below, the automatic loading of the stacks on an output instrumentality such as a feed unit 41 at the output position 40.

The feed unit 41 is thereafter used to feed a device such as a printer (not shown) which imprints the transported sheets in the manner desired. For that purpose the feed unit 41 includes a hopper 42 which is loaded manually or automatically with sheets 23 of material from the stacks 21 and 22. The sheets 23 are subsequently fed from the hopper 42 into pinch rollers such as 43-1 and 43-2 and then out of the unit 41.

It is to be noted that with the conveyors 100 through 400 positioned horizontally as shown in FIG. 1, their associated drive motors (not shown in FIG. 1) may be operated to provide automatic transport of the stacks 21 and 22 from the input position 30 to the output position 40. In addition, if the conveyors 100 through 400 are not operated automatically, the stacks may be moved manually from the input position 30 to the feed position 40 by being pushed over the horizontally extended conveyor system 10'. Thus the system 10' is directly usable even if temporary shut down is required, for example, for the repair of a particular component.

In general, however, the invention contemplates the use of the alternative system 10' for the automatic loading of the instrumentality 41. This is accomplished by the feed of the stacks over the initial conveyors 100 and 200, and by using them to reorient the stacks, followed by feed over the third conveyor 300, in an upwardly pivoted position, and final feeding to the hopper 42 by the belt conveyor 400, in its generally horizontal extended position.

Figure 2A:
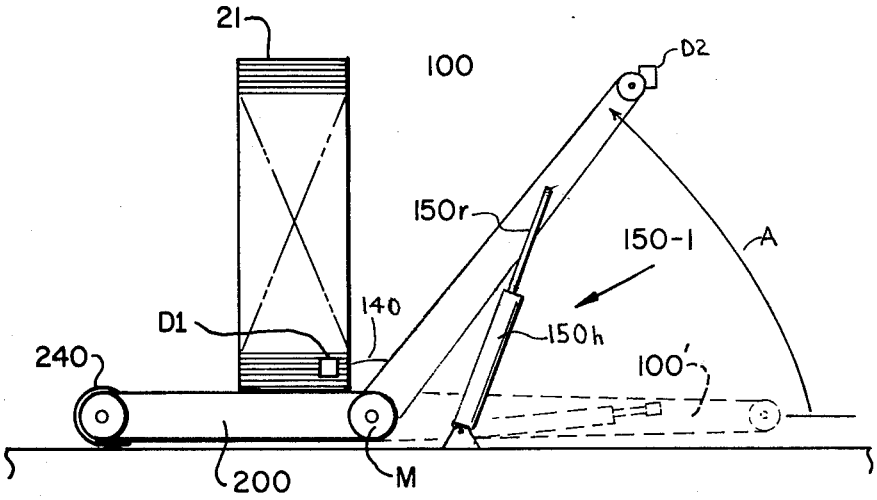
Figure 2B:
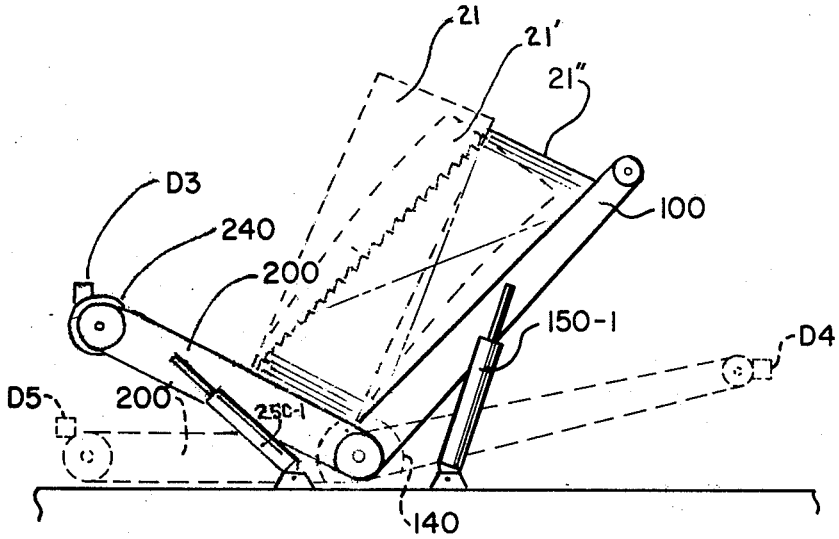
Figure 2C:
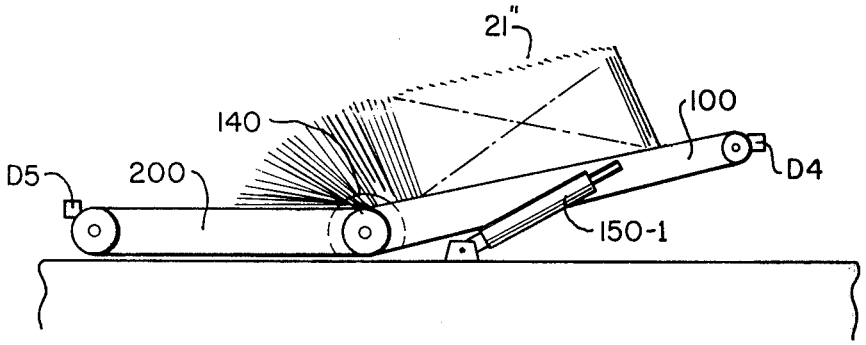
Figure 3:
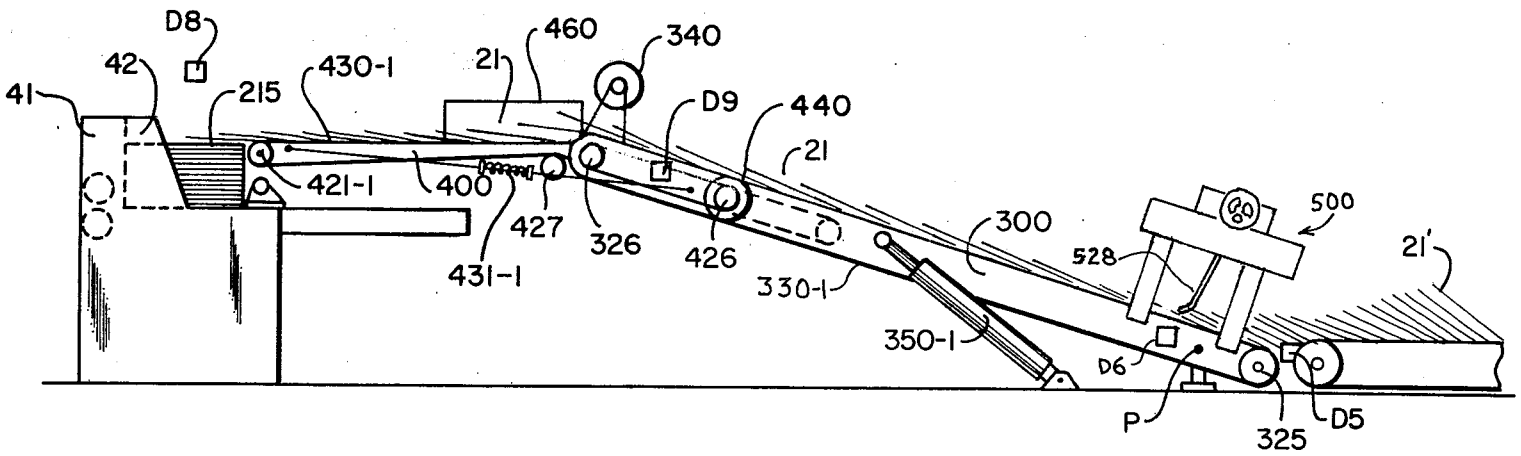
FIG. 3 is a side view of output constituents for the system of FIG. 1, including shingling and output conveyors, a stripper unit, and an output unit.
Figure 4:
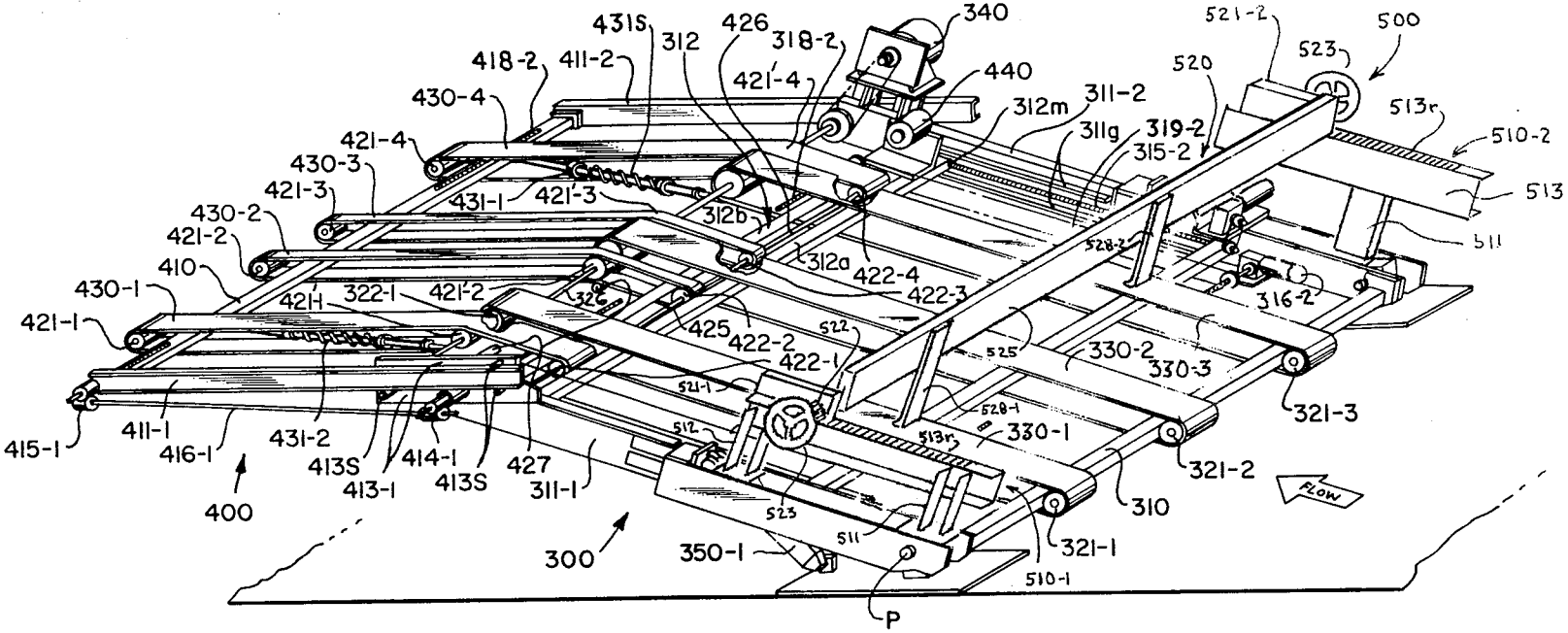
FIG. 4 is a perspective view of the shingling and output conveyors, and the stripper unit, of FIG. 3.

The first two conveyors 100 and 200 are illustrated in FIG. 1, and their operation is illustrated by FIG. 2, while the operations of the remaining conveyors 300 and 400 are considered in conjunction with FIGS. 3 and 4.

Details of the first two conveyors 100 and 200 can be set as forth in the perspective view of FIG. 2 in Ser. No. 545,038.

The illustrative incoming stack 21 in FIG. 1 is reoriented by the operation of the pivotable conveyors 100 and 200 in the manner illustrated by FIGS. 2A through 2C.

As shown in FIG. 1, the conveyors 100 and 200 are initially coplanar and extend horizontally with respect to the support surface such as the floor F. In their horizontal positions belts of the conveyor 100 are operated by a motor 140 through a shaft M (FIG. 2A). Simultaneously belts of the conveyor 200 are operated by a motor 240. A stack of materials, such as the stack 21 shown in FIG. 1, is then moved to the first conveyor 100. The moving belts of the conveyors 100 and 200 cause the stack 21 to be transported completely over the first conveyor 100 and on to the second conveyor 200 until the trailing edge of the stack has cleared the pivot position of the first conveyor 100 about the main pivot shaft M.

Once the stack 21 is in the desired position, as shown in FIG. 2A, a detector D1 such as a photoelectric cell or other suitable type of switch causes the motors 140 and 240 of the respective conveyors 100 and 200 to come to a stop. After a short and suitable delay interval, the hydraulic cylinders 150-1 and 150-2 of the first conveyor 100 (with only cylinder 150-1 visible in FIG. 2A) are operated to pivot the conveyor 100 about the main shaft M, raising it from its phantom position 100' to the angular position shown in FIG. 2A. At that point a second detector D2, such as a switch, is operated to initiate elevation of the second conveyor 200 by its hydraulic cylinders 250-1 and 250-2.

When the second conveyor 200 becomes sufficiently elevated, as shown in FIG. 13B, the stack 21, indicated in phantom, becomes unstable and falls en masse, as indicated at the phantom position 21', towards the first conveyor 100. The impact of the stack with the first conveyor breaks the cohesive forces between sheets and produces the initially shingled stack 21''.

In order to produce the desired initial shingle, the angle A of the conveyor 100 should be in the range from 40° to 80°. When the angle A is below 40°, the stack tends to become disoriented. The preferred range for the angle A has been found to be 50° to 60°, with desirable results obtained for an elevation of 55°.

When the switch D5 is released by the upset conveyor 200, the motor 140 of the backrest conveyor 100 operates in a reverse direction to further increase the initial shingling, i.e., separation, of the members of the stack. The backrest conveyor 100 remains in its elevated position, illustratively with an angle of elevation of approximately 20° during subsequent automatic feeding of the members of the stack to the hopper 42 of the output unit 41 (FIG. 3). After the members of the stack 21'' have cleared the detector D1 (FIG. 2A), the backrest conveyor 100 is returned to its initial position in preparation for the transport of the next stack to the upset position.

For automatic feed to take place from the second conveyor 200 to the hopper 42, the third conveyor 300 of FIG. 12 and its associated, retracted conveyor 400 are oriented as shown in FIG. 3.

The third conveyor 300 is generally similar in configuration to the second conveyor 200 and includes a pivot P at one end of the frame and an associated drive motor 340, a set of drive belts, of which one such belt 330-1 is visible in FIG. 14, and a pair of hydraulic cylinders for elevating the conveyor 300; one of the cylinders 350-1 being visible in FIG. 14. Associated with the shingling conveyor 300 is a stripper unit 500 which assures the desired shingling of the sheets being transported. The fourth or horizontal feed conveyor 400 can be as described in detail in Ser. No. 545,038.

The hydraulic cylinders 350 of the third conveyor 300 are actuated to raise the conveyor to its shingling position as shown in FIG. 3, and the fourth conveyor 400 is extended to the hopper feed position of the output unit 41.

Details of the third and fourth conveyors 300 and 400 are set forth in the perspective view of FIG. 4.

The support structure of the conveyor 300 is a frame 310 with side arms 311-1 and 311-2. The outward end of the frame 310 includes a cross bar assembly 312 with individual members **312*a* and 312*b* that are joined to mounting plates 312*m*. The latter are slidable along a path defined by guide rails 311*g*, of which only the guide rail of the remote arm 311-2 is visible in FIG. 4.**

Included at the end of the frame 310 near the output conveyor 400 is a drive shaft 326 for drive belts 330-1 through 330-3. The belts are supported by drive pulleys 322-1 through 322-3 on the drive shaft 326 and by idler pulleys 321-1 through 321-3 on the other end of the frame 310.

In the case of the frame 310, the support structure for the idler pulleys 321-1 through 321-3, at the end of the frame, has been omitted for simplicity, but it will be understood that conventional brackets and shafts are used to mount the pulleys in standard fashion and that pivotal plates may be used to prevent the sheets from falling between the conveyors 200 and 300.

Motive power for the third conveyor 300 is provided by a hydraulic drive motor 340 which is coupled to the drive shaft 326; and the conveyor 300 is elevated and lowered by hydraulic cylinders 350-1 and 350-2.

The third conveyor includes gear head motors 316, of which only the remote motor 316-2 is shown, for adjusting the spacings of the outer belts 330-1 and 330-3. The desired adjustments are effected by lead screws that are connected in conventional fashion (not shown) for side to side movement of the associated belts 330-1 and 330-3.

Also seen in FIG. 4 is the stripper unit 500 that is associated with the shingling conveyor 300.

The stripper unit 500 is formed by supports 510-1 and 510-2 respectively mounted on side arms 311-1 and 311-2, for a removable stripper assembly 520.

Each of the supports 510-1 and 510-2 includes posts 511 and 512, and a transverse piece 513. The latter has a rack 513*r* to permit longitudinal adjustment, i.e., along the direction of feed, for the assembly 520.

The assembly 520 includes side panels 521-1 and 521-2 that are removably roller mounted on the transverse pieces 513. Each of the side panels 521-1 and 521-2 has a pinion 522 that meshes with the rack 513*r* and permits the assembly 520 to be adjusted through a common shaft 524 by operation of a control wheel 523.

Figure 5B:
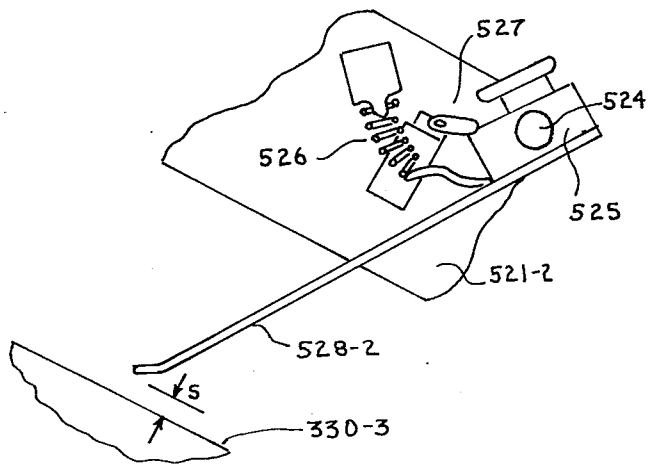
FIG. 5B is a detailed view of a stripper finger in the stripper of FIG. 5A.
Figure 5A:
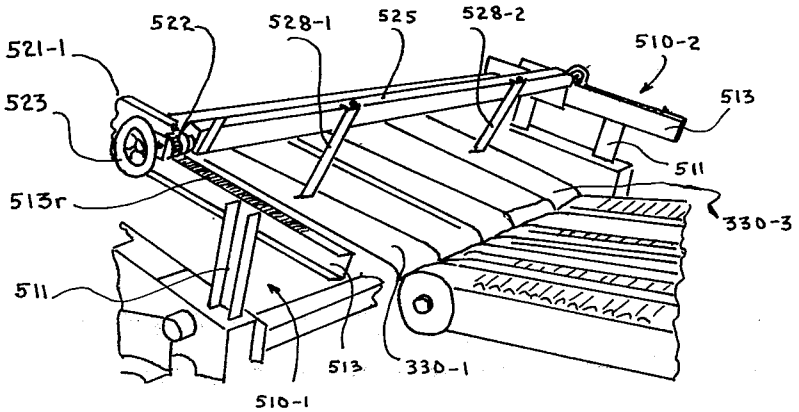
FIG. 5A is a perspective view showing another view of the stripper of FIG. 4

Journalled in the side panels 521-1 and 521-2 is a pivot shaft 524 to which is affixed a cross support 525. At each extremity of the cross support 525 there is a coil spring 526 and a limit switch 527. Positioned along the cross support 525 are fingers 528-1 and 528-2 which are associated with the respective belts 330-1 and 330-2. Since the belts 330-1 and 330-2 are laterally adjustable, the fingers 528-1 and 528-2 are correspondingly laterally adjustable. Constructional details for the stripper unit 500 and the precise relationship of each coil spring 526 and limit switch 527 to the cross support 525 are shown in auxiliary FIGS. 5A and 5B.

The fingers 528-1 and 528-2 are positioned as close as possible to their associated belts 330-1 and 330-2 without producing a jam. In practice a spacing of greater than about ¼ inch, and preferably ½ inch has been found to be suitable. The longitudinal setting of the assembly 520 is advantageously set so that the distance from the tip of each of the fingers 528-1 and 528-2 to the input position of the shingling conveyor 300 is about the individual length of the sheets being shingled.

As indicated in FIG. 3, the result of having the stripper unit 500 is to assure relatively uniform shingling of the sheets being transported along the shingling conveyor 300. If a clump of sheets appears at the fingers 528, they are pivoted upwardly, causing the limit switch 527 (FIGS. 5A and 5B) to close and interrupt the drive motor 240 of the second conveyor 200 (FIG. 2). The drive motor 340 of the shingling conveyor 300 continues in operation, causing the sheets of the clump to feed with proper shingling, as determined by the tension of the coil springs 526 (FIG. 5B) and spacing of the fingers 528 from the belts 330.

In summary of the operation of the entire system 10′, the motors 340 and 440 of the shingling and output conveyors 300 and 400 are actuated when the stack 21 is initially moved on the first conveyor 100. After the stack 21 has been reoriented by the action of the backrest and upset conveyors 100 and 200 as shown in FIG. 2C, the forward motion of the conveyor belts carries the sheets to the shingling conveyor 300, where proper separation of the sheets is assured by the stripper unit 500, and the sheets are fed by the output conveyor 400 into the hopper 42.

Figure 6:
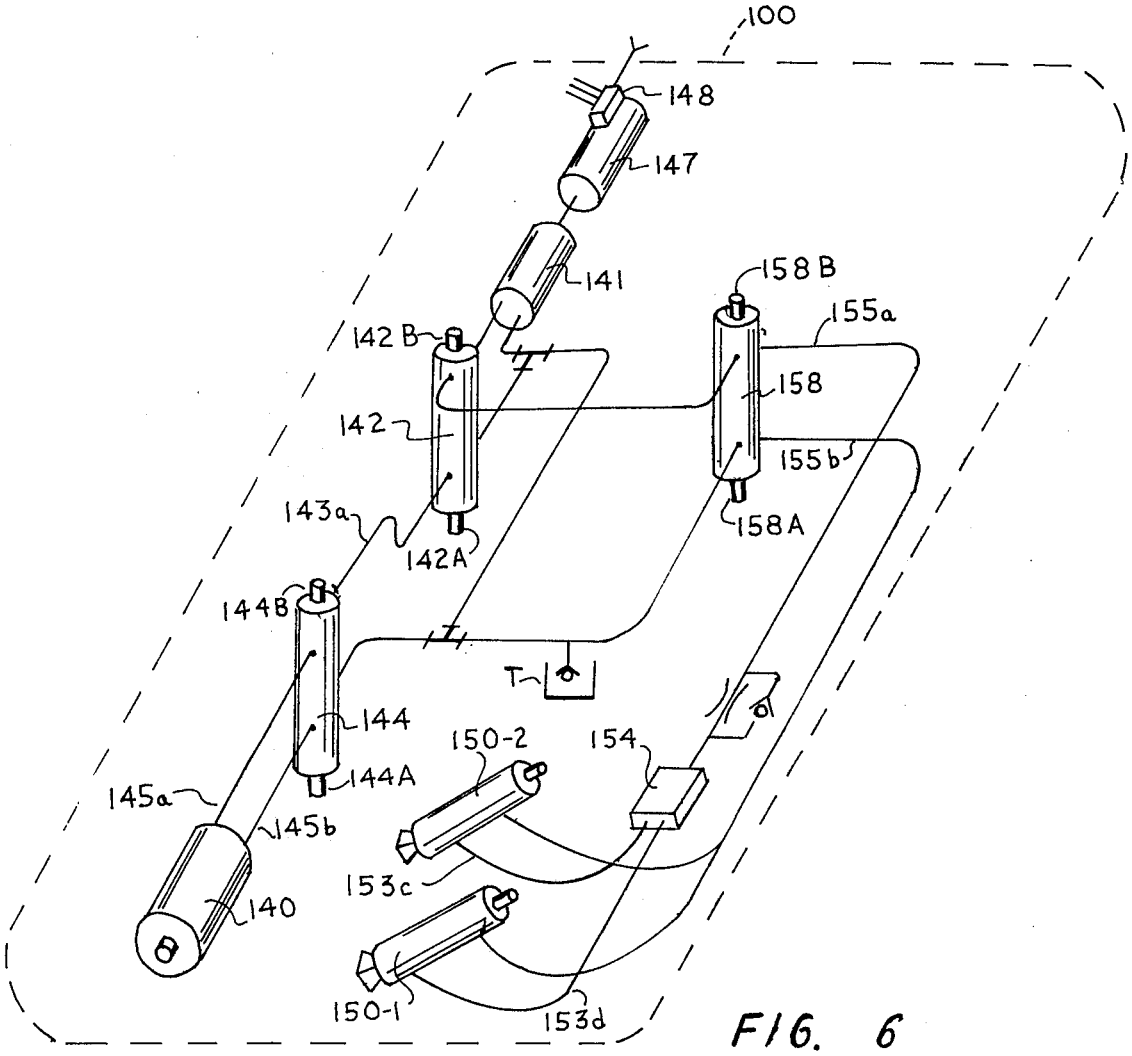
FIG. 6 is a perspective and connection diagram for the hydraulic circuitry of FIGS. 1 and 4.

Illustrative hydraulic circuitry for controlling the conveyor 100 of the system 10′ of FIG. 1 is illustrated in FIG. 6. Identical circuitry is used for the conveyor 200, while the circuitry for the conveyors 300 and 400 can be as shown in Ser. No. 545,038.

As shown in FIG. 6, the motor 140 for the conveyor 100 is operated from a pump 141 through a proportional control valve 142 and a directional valve 144. The pump 141 is driven by a three-phase motor 147 with a starter 148.

The proportional control valve 142 causes fluid to appear on line 143*b* in proportion to the magnitude of the voltage applied to control terminal 142*B*. Similarly, a proportional flow of fluid appears on line 143*a* according to the voltage applied to control terminal 142*A*.

A directional valve 144 produces flow from line 143*a* to line 145*a*, and consequently from line 145*b* to line 145*t*, when solenoid 144*A* is energized, and a cross flow, e.g. to line 145*b* from line 143*a* and a return from line 145*a* to line 145*t*, when solenoid 144*B* is energized. This has the effect of reversing the operation of the motor 140 at a speed governed by the magnitude of the signal applied to valve 142.

The pump unit 141 and the hydraulic motor 140 can be as described in Ser. No. 545,038. The hydraulic cylinders 150-1 and 150-2 are operated through a directional valve 158.

The system 10′ may be controlled manually (as interrupted by the action of the limit switch on the shingling unit 500 described above), or it may be implemented to operate automatically along the lines set forth in Ser. No. 545,038.

Figure 7A:
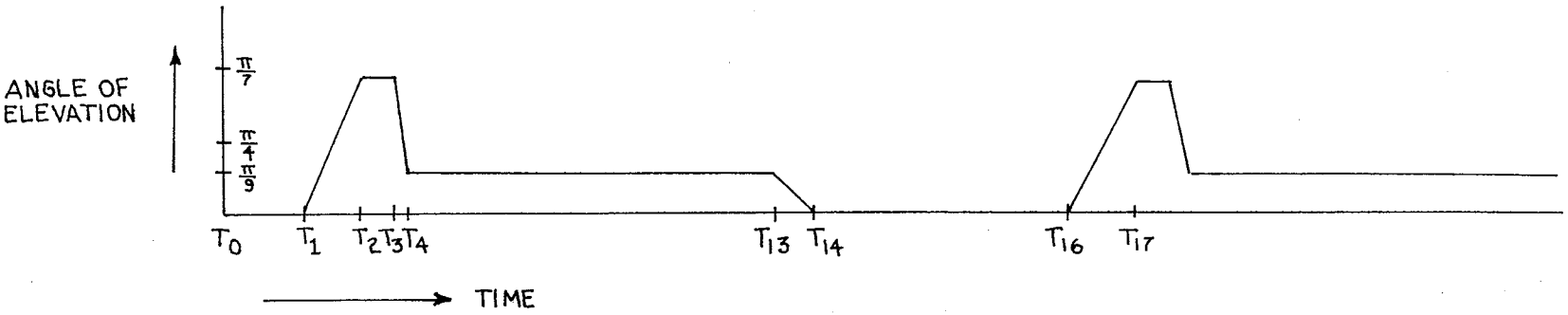

In any event, shortly after the stack 21 has reached the position shown in FIG. 2A, e.g. about the time $T_1$ in FIG. 7A, solenoids 142B and 152B (FIG. 6) are operated to permit fluid from pump 141 to flow to the backrest cylinders 150-1 and 2 and elevate the backrest conveyor 100. At the desired angle of elevation (FIG. 2A) a normally closed switch of the second detector D2 opens momentarily and causes the previously energized solenoids to be de-energized at time $T_2$ in FIG. 7A.

Simultaneously there is closure of a normally open switch which operates relays to energize solenoids and begin the elevation of the upset conveyor and gravity fall of the backrest conveyor 100.

When the backrest and upset conveyors reach the position shown in FIG. 2B, at time $T_4$ in FIG. 7A, detector D3 operates and deactivates solenoids by the momentary opening of contacts. This allows the upset conveyor 200 to remain in an inclined position while the backrest conveyor continues its fall until it reaches detector D4 in FIg. 2C. This opens cntacts at time $T_4$ (FIG. 7A) to hold the backrest conveyor 100 at the D4 position, and allows the upset conveyor to fall until it again becomes horizontal as shown in FIG. 2C.

Subsequently, when the stack clears the photo detector D1 a solenoid is activated at time $T_{13}$ (FIG. 7A) and the backrest conveyor is returned to its horizontal condition, actuating detector D7 and its contacts to complete the first cycle of stack reorientation.

On the next cycle, the prior cycle is repeated.

Figure 7B:
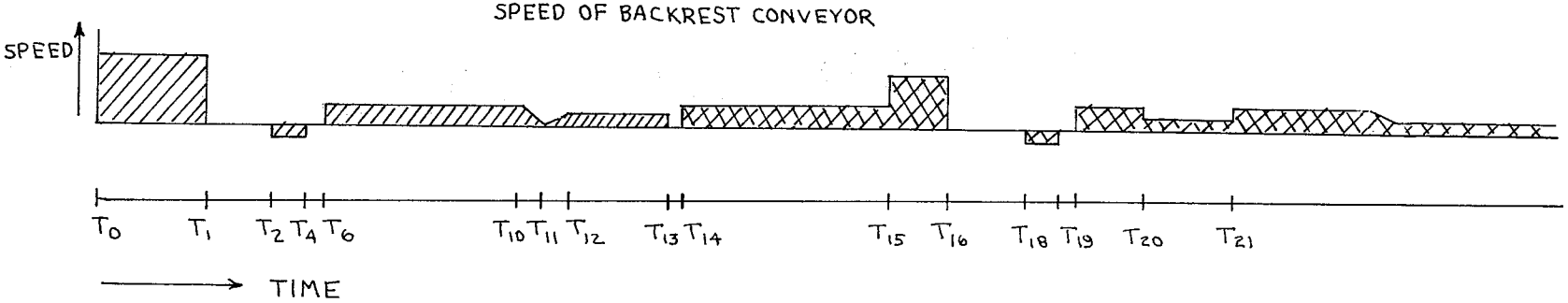

The operation of the conveyor motors is considered in connecting with FIG. 7B, which is a graph of speed versus time for the backrest conveyor 100.

On start-up at time $T_0$, by closing switch contacts, voltage is applied to solenoids 142A and 144A to cause motor 140 to operate in a forward direction at a rate $R_1$, for example 50 feet per minute. Simultaneously voltage is applied to the solenoids that control motors 240, 340 and 440, causing them to being operating at their predetermined initial speeds $R_2$, $R_3$, and $R_4$, for example 50, 100 and 100feet per minute.

As shown in FIG. 7B, conveyor 100 operates until the incoming stack actuates the photo detector D1, resulting in the momentary opening of the contacts and stopping it and the conveyor 200 at time $T_1$.

There is then a hiatus while the conveyors are elevated and lowered, as previously described, until the upset conveyor 200 is elevated to actuate detector D5 and close its associated contacts (FIG. 2B). This causes the backrest conveyor motor to reverse its direction of rotation at an illustrative speed of 10 feet per minute and helps to separate the members of the stack and accentuate the desired initial shingling effect as shown in FIG. 2C.

The upset conveyor 200 is then lowered to the position shown in FIG. 2C at time $T_6$ and the detector D5 is activated. This restores the forward motion of the conveyor 100, under the control, however, of a reduced voltage, which reduces the speed, for example to 10 feet per minute, and also restores the motion of conveyor 200, but also at a reduced rate, for example 25 feet per minute, as indicated at time $T_6$ in FIG. 7B. The operation can then continue as indicated, or in any other suitable manner.

While various aspects of the invention have been set forth by the drawings and the specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. The method of transporting and reorienting a stack of materials which comprises the steps of:

a. conveying the stack to a prescribed position on and by one driven feed conveyor;

b. pivoting another driven feed conveyor to a prescribed angular position relative to the one conveyor;

c. tilting said stack and letting it fall freely against the other conveyor to simultaneously upset and shingle said stack;

d. positioning said other conveyor for the feed of the upset stack therefrom;

e. substantially uniformly increasing the shingle of said stack.

2. The method of claim 1 wherein a. said stack is conveyed to said prescribed position over said other conveyor to said one conveyor and said other conveyor is thereafter elevated; and b. said stack is upset and simultaneously shingled by elevating said one conveyor.

3. The method of claim 1 wherein said other conveyor is elevated in the range from 40° to 80°.

4. The method of claim 1 wherein the surface of the belting of said other conveyor in contact with said stack is smoother than the surface of the belting of said one conveyor in contact with said stack.

5. The method of claim 1 wherein the step of uniformly increasing the shingle of said stack is performed by a stripper unit overlying a path along which the stack is fed from the position where it is upset.

6. The method of claim 5 wherein said stripper unit is removable from its position overlying said path.

7. The method of claim 5 wherein said stripper unit includes at least one pivotable finger that extends downwardly to the path of said stack.

8. The method of claim 7 wherein said finger is spaced from said path by at least one-quarter inch.

9. The method of claim 5 wherein said stripper unit operates a limit switch when a predetermined force is applied to said stripper unit by said stack, to terminate the feed of the upset stack.

10. The method of claim 5 wherein said stripper unit is mounted on a third conveyor at the output of said other conveyor.

11. The method of claim 1 wherein a. said stack is conveyed over and on said one conveyor to said prescribed position, said prescribed position being on said one conveyor, and said other conveyor is thereafter elevated; and b. said stack is upset and simultaneously shingled by elevating said one conveyor.

* * * * *